US005355578A

United States Patent [19]

Van Den Berg et al.

[11] Patent Number: 5,355,578

[45] Date of Patent: Oct. 18, 1994

[54] METHOD OF MANUFACTURING A DEFLECTION UNIT

[75] Inventors: Hendrik Van Den Berg; Jacobus Jamar; Bernardus Dekkers, all of Eindhoven, Netherlands

[73] Assignee: U.S. Philips Corporation, New York, N.Y.

[21] Appl. No.: 945,475

[22] Filed: Sep. 16, 1992

[30] Foreign Application Priority Data

Sep. 23, 1991 [EP] European Pat. Off. ..... 91202456.9
May 18, 1992 [EP] European Pat. Off. ..... 92201398.2

[51] Int. Cl.[5] ..... H01F 41/06
[52] U.S. Cl. ..... 29/605; 156/73.1; 264/272.15; 264/272.19
[58] Field of Search ..... 29/605; 264/272.15, 264/272.19; 156/73.1, 73.2, 73.5, 73.6

[56] References Cited

U.S. PATENT DOCUMENTS 1,739,246 12/1929 Majce ..... 29/605 X
3,541,682 11/1970 Hildebrandt ..... 29/605

FOREIGN PATENT DOCUMENTS 751707 7/1956 United Kingdom .

*Primary Examiner*—Carl E. Hall
*Attorney, Agent, or Firm*—Robert J. Kraus

[57] ABSTRACT

Method of manufacturing a deflection unit comprising a set of diametrical deflection coils, in which method the coils are placed on a jig which supports each coil at a plurality of locations and in which a coil support of synethic material is urged against the free surface of each coil. The coils are mechanically anchored by means of, for example an ultrasonic welding process in which the locations of the coil support situated opposite supported locations of the coils are softened and pressed into the coils. The coils are not deformed in that case and their mutual position defined by the jig is accurately maintained.

5 Claims, 3 Drawing Sheets

METHOD OF MANUFACTURING A DEFLECTION UNIT

BACKGROUND OF THE INVENTION

The invention relates to a method of manufacturing a deflection unit for a cathode my tube, which method comprises the step of mounting a set of saddle-type deflection coils on a surface of a hollow synthetic material coil support.

In this respect deflection unit is understood to mean a deflection unit for deflecting an electron beam in the horizontal direction, in the vertical direction or in both directions.

The invention particularly relates to the step of mounting the self-supporting deflection cons (referred to as saddle cons) for deflection in the horizontal direction on the inner surface of a coil support, but the invention is not limited thereto.

In practice, deflection coils have hitherto been mostly mounted (positioned and fixed) on an inner or outer surface of the con support mechanically, for example, by means of snap connections, projections or other auxiliary means. A drawback of these methods is that the cons are forced to adapt their shape to the shape of the coil support and/or to the shape of the auxiliary means. Tolerances between the support and the coils and differences in expansion between the coils and the support will adversely influence the reproducibility of the deflection fields generated by the deflection units obtained: there will be spreads. Methods in which positioning means such as projections are used for positioning the coils during the mounting operation and in which glues are used for fixing do not provide a substantial improvement in this respect.

SUMMARY OF THE INVENTION

The invention has, inter alia, for its object to provide a novel mounting method which inhibits or eliminates the above-mentioned problems.

A method of the type described in the opening paragraph is therefore characterized in that the deflection coils are placed on a jig which supports the inner surface of each coil at a plurality of locations and in that the inner surface of the coil support is urged against the outer surface of each supported coil, whereafter the material of the coil support is softened for a short period of time by applying thermal energy at locations situated opposite locations where the coils are supported and is urged towards the coils so that the support is pressed into the coils at said locations.

In the method according to the invention the coils are arranged in an accurately spaced relationship by using an (accurately formed) jig during fixing. In this method they maintain their shape. The coil support is deformed and pressed into the coils by locally softening the support material. In this way the unreformed coils are mechanically anchored. This yields an improved reproducibility of the fields generated by a deflection unit comprising a (line) deflection coil system obtained in such a manner.

The operations of locally softening the material of the coil support and pressing the softened material into the coil can be carried out in a very practical manner in one step by making use of an ultrasonic welding method.

The process described above results in a mechanical anchoring of the deflection coils. An increased extent of adhesion can be realised if the coil wires are enveloped by a material which softens during the ultrasonic welding process.

In addition to the above-described advantage, the invention has a further advantage: various types of coils having different dimensions but intended for cathode ray tubes having the same deflection angle and neck diameter can be secured to one type of coil support because projections, snap connections and the like are not required. This is particularly advantageous when relatively small series of deflection units having different properties are to be manufactured, as in, for example EVTV.

The method described hereinbefore is based on positioning and fixing (line) deflection coils on the inner surface of a coil support. However, the invention may also be used for positioning and fixing (field) deflection coils on the outer surface of a coil support.

The coils are preferably thermo-stable. Precisely because the effects of dimensioning spreads of the coil supports are eliminated by the method according to the invention, the use of thermo-stable coils is important. The possibilities of implementing the inventive method are enhanced by using (line) deflection coils of the semi-saddle type, or mussel type. These are coils which are wound to form two conductor side groups connected at one extremity by a connection group which is arranged in a plane extending at an angle to the plane in which the side groups are located and at the other extremity by a connection group which is arranged in the plane of the side groups.

A coil support preferably has per coil, or per coil system, at least two re-entrant elastic projections (lugs), but, for example four projections are alternatively possible, and preferably the coils are exclusively secured to these projections in the manner described hereinbefore. This has two advantages:

a. the coils are free from the support (over the greater part of their surface), which reduces spread errors;

b. expansion differences between the coils and the support which may still occur (in spite of the use of thermo-stable coils) are corrected. The support is preferably made of thermoplastic material. This facilitates the process of securing the coils, particularly when an ultrasonic welding method is used for this purpose.

A practical embodiment is characterized in that, viewed in the longitudinal direction, the support comprises at least two parts: a first part (provided or not provided with lugs) of thermoplastic material to which the coils are secured, and a second part of an arbitrary (for example, low-cost) synthetic material which is moulded or snapped onto, for example, the rear extremity of the first part. (A third part of an arbitrary synthetic material may be moulded or snapped onto the front extremity of the first part.) The second part is particularly suitable for mounting the coil support on the neck of a display tube, for example by means of a clamping ring or clamping strap and may be made of a material suitable for this function. The rear extremity is herein understood to mean the extremity where electron beams enter during operation and the front extremity is understood to mean the extremity where electron beams exit in operation.

The invention thus also relates to a deflection unit having one or more of the features described above.

BRIEF DESCRIPTION OF THE DRAWINGS

These and other aspects will be apparent from and elucidated with reference to the embodiments described hereinafter.

In the drawing.

DESCRIPTION OF THE PREFERRED EMBODIMENT

Figure 1:
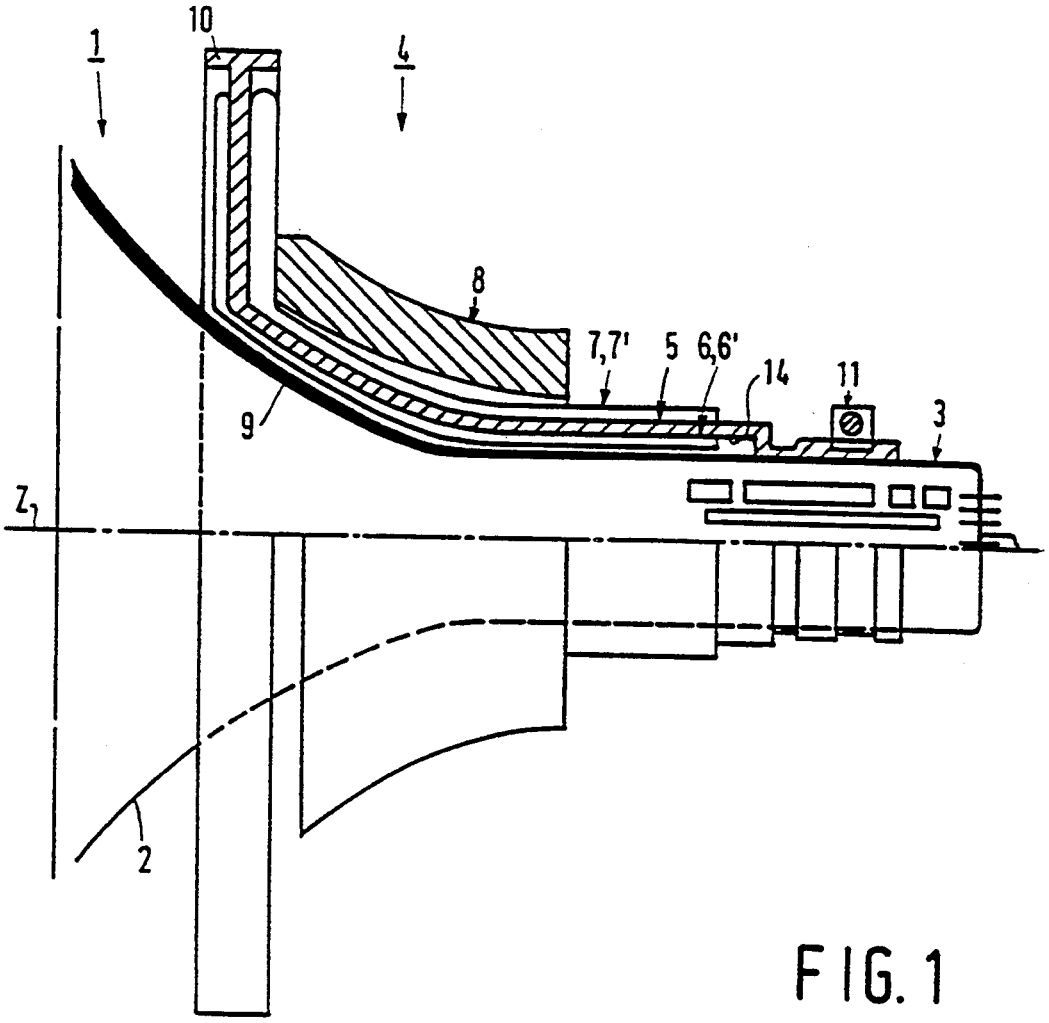
FIG. 1 shows a cathode ray tube with a deflection unit, partly in a side elevation and partly in a longitudinal section.

FIG. 1 shows a cathode ray tube 1 having a funnel-shaped portion (cone) 2 and a neck 3. A deflection unit 4 with a coil support 5 manufactured from a synthetic material and supporting a set of vertical or field deflection coils 7, 7', a set of horizontal or line deflection coils 6, 6' and a yoke ring 8 is placed on the envelope of the display tube and its front end 10 is supported by the funnel-shaped portion 2. For the support in the correct position use may be made of, for example adjusting members such as bolts or pins (not shown). After the deflection unit 4 is slid on the neck 3, its position is fixed by means of a clamping strap 11.

Figure 2:
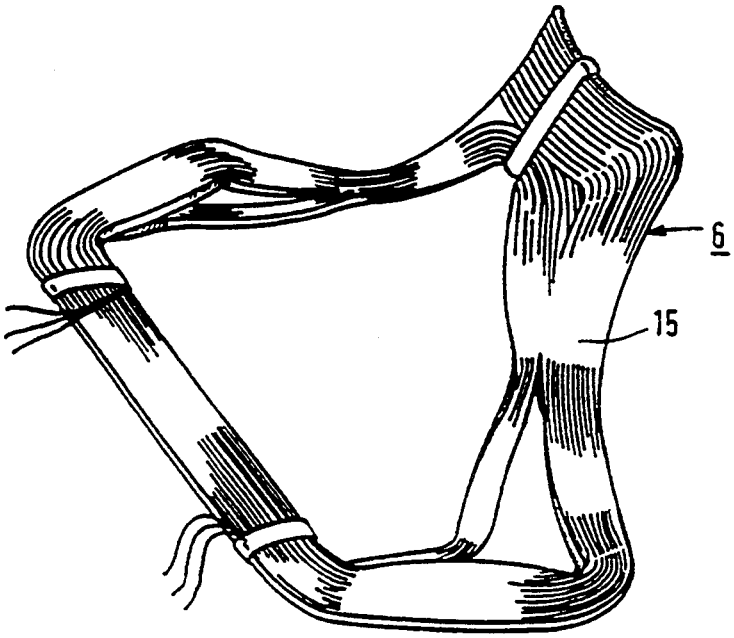
FIG. 2 is a perspective elevational view of a (line) deflection coil.
Figure 3:
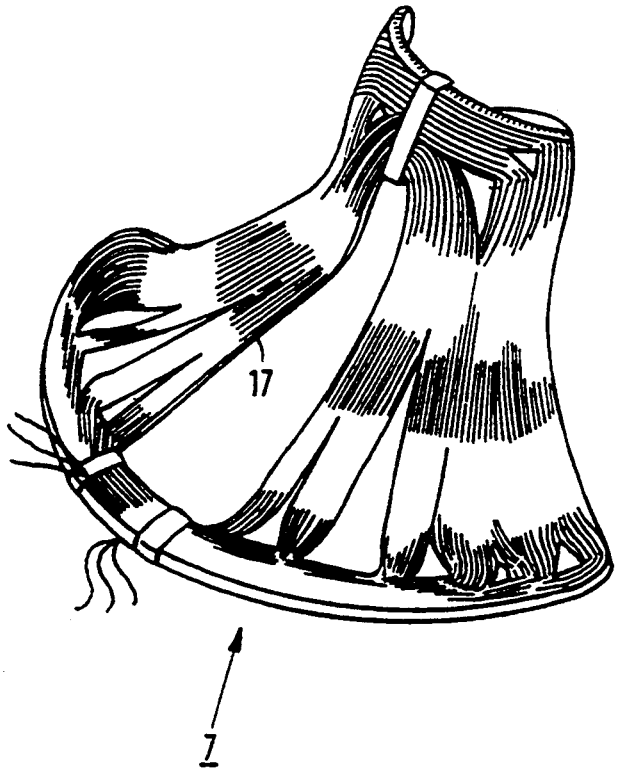
FIG. 3 is a perspective elevational view of a (field) deflection coil.

An example of a line deflection coil 6 is shown in FIG. 2 and an example of a field deflection coil 7 is shown in FIG. 3.

As is shown in FIG. 1, the line deflection coil 6 is secured to the inner surface 14 of the coil support 5. The deflection coils are positioned and fixed within the scope of the invention in the following manner.

Figure 4:
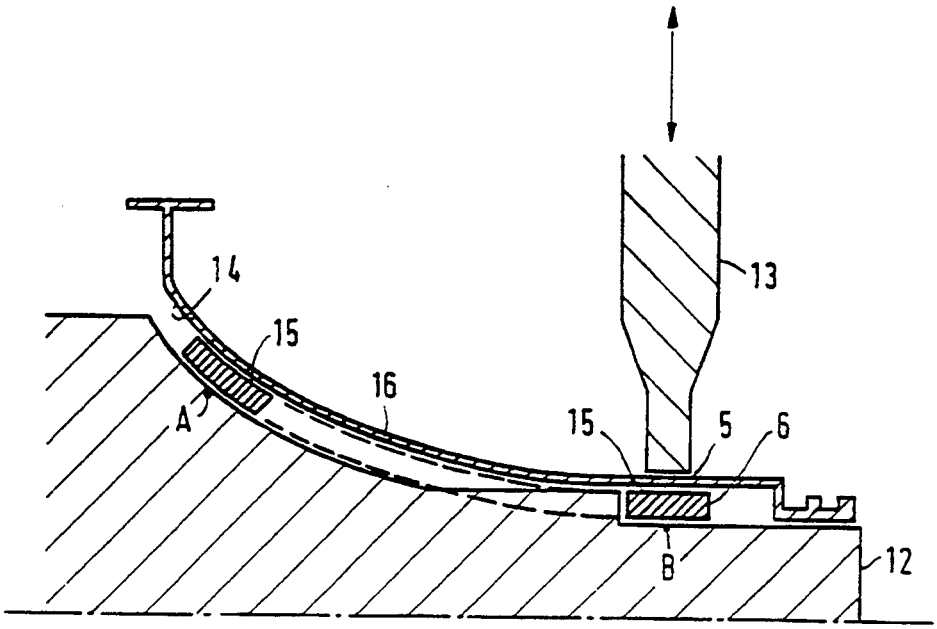
FIG. 4 shows diagrammatically a step of the inventive method of positioning and fixing deflection coils on a coil support.
Figure 5:
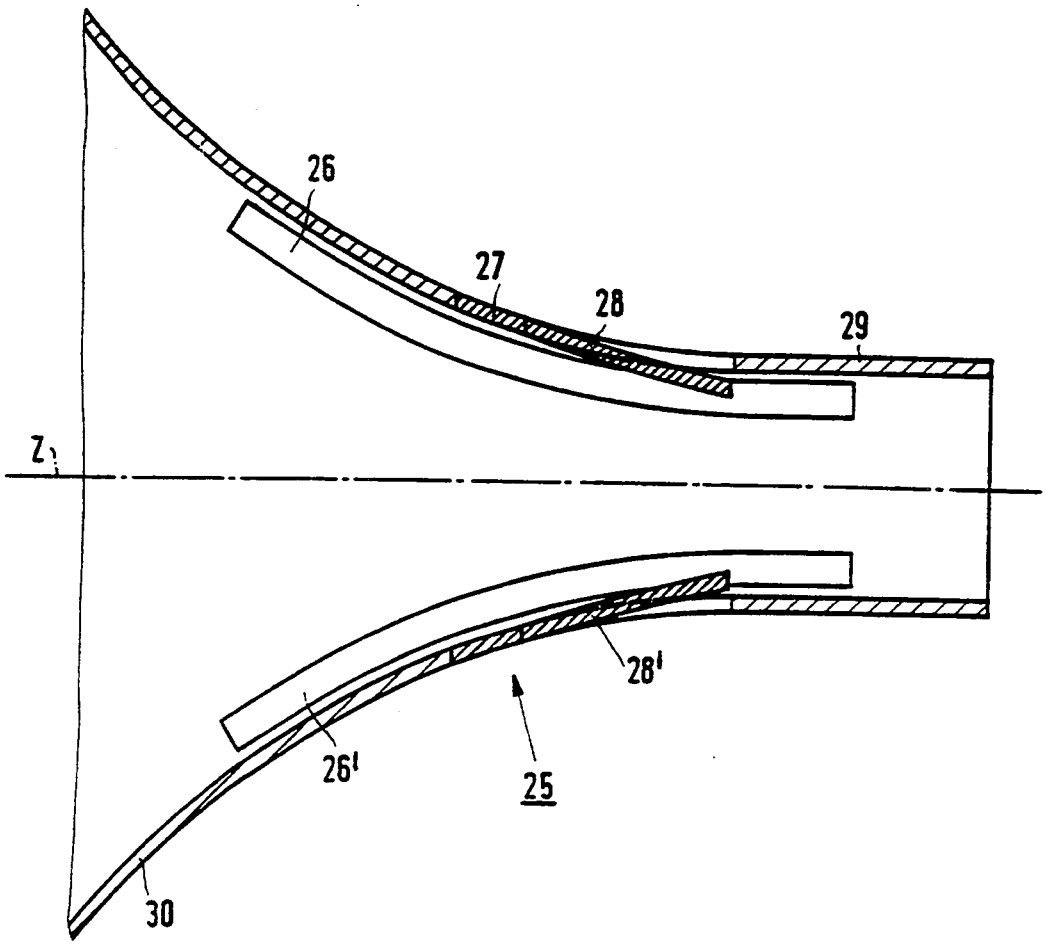
FIG. 5 is a longitudinal section of a coil support which is very suitable for the object of the invention.

The saddle-type deflection coil 6 (which consists of copper wire turns enveloped by a thermoplastic material) is subjected to a thermal treatment after the winding process in the winding jig so that the thermoplastic envelopes of the turns have melted and a self-supporting assembly is obtained. The self-supporting deflection coil 6 is placed on an accurately formed jig 12 which supports the deflection coil 6 at a plurality of locations (A and B in FIG. 4). The inner surface 14 of coil support 5 is pressed against the outer surface 15 of the deflection coil 6. Subsequently a sonotrode 13 is externally provided for performing an ultrasonic welding operation. The weld is realised at a location of the coil support 5 under which a part of the deflection coil 6 supported by the jig 12 is situated. In principle, the number of welds is unlimited and welding may be performed at arbitrary locations. The (synthetic material) coil support 5 melts at the interface between the support and the coil and is pressed into the deflection coil 6 over a small distance (on the order of 1 mm). The position and the shape of the deflection coil 6 are then not affected. The result is a mechanical anchoring of the deflection coil 6 with respect to the support 5. Due to softening of the thermoplastic envelope of the turns, the adhesion of the deflection coil 6 to the support 5 is enhanced. Simultaneously, or not simultaneously, a second (line) deflection coil forming a diametrical system with the deflection coil 6 and being accurately positioned with respect to this coil is secured to the support 5 in an identical manner. Since this is effected identically, this step is not shown in FIG. 4. The method described above renders the use of snap connections, projections and the like superfluous so that one type of coil support can be used for supporting different types of deflection coil systems. If the deflection coil 6 itself is mechanically strong enough and thermally stable, an apertured coil support ("coil frame") may be used, which is advantageous with regard to, for example, thermal energy control, acoustical properties (hum).

The inner surfaces 17 of two field deflection coils 7 (FIG. 3) may be positioned and fixed on the outer surface of a coil support in an analogous manner. The coil support may be the coil support 5 with the outer surface 16.

A "supersmooth" construction is obtained by pressing the locally softened coil support into the deflection coils. Experiments have proved that the operational accuracy of the deflection units increases if the (line) deflection coils are built in in a supersmooth manner. This is also the case if the (line) deflection coils are fixed by means of ultrasonic welding to the lugs secured to the support (particularly in such a way that they are free from the support).

This results in the following construction.

a. the method starts from thermo-stable coils 26, 26';

b. the support 25 comprises 3 parts:

a central part comprising a ring 27 with lugs 28, 28'. The ring material is preferably a (thermo-stable) thermoplastic material, so that ultrasonic welding is possible. The deflection coils, statically aligned by means of a positioning jig, are secured to the lugs by utrasonic welding. The coils are free from the support. This is favourable for: unambiguous mounting (small spread) and correction of expansion differences (between the coil and the support), a neck portion 29 is secured to the rear extremity of the central part by means of, for example a snap connection or moulding. The neck portion 29 may be made of a different material, a funnel-shaped portion 30 may be secured to the front extremity of the central part by means of a snap connection or moulding. Here again a different type of material (for example, of lower cost) may be used.

We claim:

1. A method of manufacturing a deflection unit for a cathode ray tube, which method comprises the step of mounting first and second preformed saddle-type deflection coils at predetermined positions relative to each other on respective surfaces of a hollow synthetic material coil support, characterized in that the first and second deflection coils are placed on a jig which supports an inner surface of each coil at a plurality of predetermined locations and in that an inner surface of the coil support is urged against an outer surface of each supported coil, whereafter the material of the coil support is softened for a short period of time by applying thermal energy at locations situated opposite locations where the coils are supported and is urged towards the coils so that the support is pressed into the coils at said locations without substantially deforming the coils.

2. A method of manufacturing a deflection unit for a cathode ray tube, which method comprises the step of mounting first and second preformed saddle-type deflection coils at predetermined positions relative to each other on respective surfaces of a hollow synthetic material coil support, characterized in that the first and second deflection coils are placed on a jig which supports an outer surface of each coil at a plurality of predetermined locations and in that an outer surface of the coil support is urged against an inner surface of each supported coil, whereafter the material of the coil support is softened for a short period of time by applying thermal energy at locations situated opposite locations where the coils are supported and is urged towards the coils so that the support is pressed into the coils at said locations without substantially deforming the coils.

3. A method as claimed in claim 1 or 2, characterized in that the material of the coil support is locally softened and pressed into the coils by means of an ultrasonic welding method.

4. A method as claimed in claim 1 or 2, characterized in that thermo-stable deflection coils are used.

5. A method as claimed in claim 1, characterized in that deflection coils are used which are each wound to form two conductor side groups connected at one extremity by a connection group which is arranged in a plane extending at an angle to the plane in which the side groups are located and at the other extremity by a connection group which is arranged in the plane of the side groups.

* * * * *